US010767930B2

(12) United States Patent
Tockert et al.

(10) Patent No.: US 10,767,930 B2
(45) Date of Patent: Sep. 8, 2020

(54) CHARGING INSTALLATION OF A METALLURGICAL REACTOR

(71) Applicant: Paul Wurth S.A., Luxembourg (LU)

(72) Inventors: Paul Tockert, Berbourg (LU); Ernesto Pellegrino, Dudelange (LU); René Hientgen, Moestroff (LU)

(73) Assignee: PAUL WURTH S.A., Luxembourg (LU)

( * ) Notice: Subject to any disclaimer, the term of this patent is extended or adjusted under 35 U.S.C. 154(b) by 73 days.

(21) Appl. No.: 15/316,817

(22) PCT Filed: Jun. 4, 2015

(86) PCT No.: PCT/EP2015/062510

§ 371 (c)(1),
(2) Date: Dec. 6, 2016

(87) PCT Pub. No.: WO2015/185694

PCT Pub. Date: Dec. 10, 2015

(65) Prior Publication Data

US 2017/0146295 A1 May 25, 2017

(30) Foreign Application Priority Data

Jun. 6, 2014 (LU) ..... 92471

(51) Int. Cl.
*F27B 3/24* (2006.01)
*F27B 3/18* (2006.01)
(Continued)

(52) U.S. Cl.
CPC ..... *F27B 3/24* (2013.01); *F27B 1/20* (2013.01); *F27B 3/18* (2013.01); *F27D 1/0033* (2013.01); *F27D 1/12* (2013.01)

(58) Field of Classification Search
CPC ..... F27B 3/18; F27B 3/24; F27B 1/20
See application file for complete search history.

(56) References Cited

U.S. PATENT DOCUMENTS 4,045,168 A * 8/1977 Abrial ..... F27D 1/0009 432/247
4,441,698 A * 4/1984 Limque ..... C21D 9/22 266/124

(Continued)

FOREIGN PATENT DOCUMENTS

CN 1285498 A 2/2001
CN 1871488 A 11/2006

(Continued)

OTHER PUBLICATIONS

International Preliminary Report on Patentability dated Jun. 16, 2016 re: Application No. PCT/EP2015/062510; pp. 1-12; citing: LU 83 402 A1.

(Continued)

*Primary Examiner* — Steven S Anderson, II
(74) *Attorney, Agent, or Firm* — Cantor Colburn LLP

(57) ABSTRACT

The invention relates to a charging installation (1) of a metallurgical reactor, with a cooling assembly (4) disposed for cooling a reactor side of the charging installation (1). In order to facilitate the installation and maintenance of a heat protection shield in a charging installation of a metallurgical reactor, the cooling assembly (4) comprises a plurality of cooling panels (10), each cooling panel (10) comprising at least one coolant channel (12). The channel (12) is formed as a groove in the base plate (11), which groove is covered by a cover plate (13) mounted on the base plate (11).

15 Claims, 2 Drawing Sheets

(51) Int. Cl.

| | |
|---|---|
| ***F27B 1/20*** | (2006.01) |
| ***F27D 1/00*** | (2006.01) |
| ***F27D 1/12*** | (2006.01) |

(56) References Cited

U.S. PATENT DOCUMENTS

| | | | | |
|---|---|---|---|---|
| 5,163,831 | A * | 11/1992 | Hammond | F27D 1/004 110/336 |
| 6,481,946 | B1 | 11/2002 | Lonardi et al. | |
| 2007/0272172 | A1* | 11/2007 | Kawaguchi | F22B 37/001 122/510 |
| 2013/0008636 | A1* | 1/2013 | Smith | C21B 7/106 165/169 |

FOREIGN PATENT DOCUMENTS

| | | | | |
|---|---|---|---|---|
| CN | 2881290 | Y | 3/2007 | |
| CN | 101046323 | A | 10/2007 | |
| CN | 202630692 | U | 12/2012 | |
| CN | 103525961 | A | 1/2014 | |
| DE | 10120614 | A1 * | 10/2002 | C21B 7/10 |
| EP | 1077358 | A1 * | 2/2001 | F27B 1/24 |
| EP | 1528343 | A1 * | 5/2005 | C21B 7/06 |
| EP | 1801241 | A1 | 6/2007 | |
| JP | S5521577 | A | 2/1980 | |
| JP | 11335711 | A | 12/1999 | |
| JP | 2003183712 | A | 7/2003 | |
| JP | 2007238975 | A | 9/2007 | |
| JP | 2011214020 | A | 10/2011 | |
| LU | 83402 | A1 | 4/1983 | |
| WO | 0063446 | A1 | 10/2000 | |
| WO | 2006089868 | A1 | 8/2006 | |
| WO | 2012016902 | A1 | 2/2012 | |
| WO | WO 2012016902 | A1 * | 2/2012 | C21B 7/20 |

OTHER PUBLICATIONS

International Search Report dated Aug. 7, 2015 re: Application No. PCT/EP2015/062510; pp. 1-4; citing: LU 83 402 A1, WO 2006/089868 A1, JP S55 21577 A, WO 2012/016902 A1, U.S. Pat. No. 6,481,946 B1 and EP 1 801 241 A1.

Written Opinion dated Aug. 7, 2015 re: Application No. PCT/EP2015/062510; pp. 1-6; citing: LU 83 402 A1.

TW Examination Report dated Mar. 22, 2018 re: application No. 104117927, pp. 1-11, citing: JP 2007-238975 A, JP 2003-183712 A, CN 101046323 A, LU 83402 A1, U.S. Pat. No. 6,481,946 B1 and WO 00/063446 A1.

CN Office Action dated Jun. 15, 2018 re: Application No. 2015800287042, pp. 1-13, citing: CN 202630692 U, CN 1285498 A, CN 2881290 A, CN 103525961 A, JP 2011214020 A, CN 1871488 A and U.S. Pat. No. 4,441,698 A.

CN Office Action dated Nov. 6, 2018 re: Application No. 2016-570291, pp. 1-6, citing: CN 202630692, JP 1999-335711 and CN 2881290.

* cited by examiner

CHARGING INSTALLATION OF A METALLURGICAL REACTOR

TECHNICAL FIELD

The invention relates to a charging installation of a metallurgical reactor. It further relates to a cooling assembly of such a charging installation and a cooling panel for such a cooling assembly.

BACKGROUND ART

Metallurgical reactors are well known in the art. These reactors are typically gravity-fed from above by a charging installation, which in turn may be fed with bulk material from intermediate hoppers. One type of charging installation is disclosed in international application WO 2012/016902 A1. Here, the material is fed through a feeder spout, which is positioned above the inlet of a distribution chute. The chute is mounted on a rotatable tubular support, in which the feeder spout is disposed. To provide for a two-dimensional mobility of the chute, it is also tiltable relative to the support by shafts connected to a gear assembly. The gear assembly is positioned inside a gearbox formed by the support and a stationary casing on which the support is rotationally mounted. For protection of the gear assembly, the bottom portion of the casing has a heat protection shield with a cooling circuit. The shield defines a central opening in which a lower portion of the support is disposed. Since the heat protection shield may be subjected to relatively high temperatures and considerable temperature changes, while there may be also high temperature gradients, there may be a need for inspection, maintenance and/or replacement of the shield or at least of parts thereof. This in particular refers to the cooling circuit, but also to a heat protection layer of refractory material, which is disposed on the underside of the cooling circuit. While a charging installation of the above-mentioned application generally works well, maintenance of the heat protection shield is often complicated and time-consuming.

BRIEF SUMMARY

The disclosure facilitates the installation and maintenance of a heat protection shield in a charging installation of a metallurgical reactor. A charging installation, a cooling assembly, and a cooling panel are provided.

A charging installation of a metallurgical reactor is provided, with a cooling assembly disposed for cooling a reactor side of the charging installation. The metallurgical reactor may in particular be of the blast furnace type. A charging installation will usually be of the type where the bulk material is gravity-fed to the reactor. Therefore, in these cases, the charging installation is—at least for the larger part—intended to be installed above the reactor. Thus, the reactor side, i.e. the side which faces the reactor, is the bottom side or underside. However, it is conceivable that the charging installation is on a different side of the reactor. The cooling assembly is disposed for cooling the reactor side, which usually means that it is disposed along the reactor side.

The cooling assembly comprises a plurality of cooling panels, each cooling panel comprising at least one coolant channel I.e., the cooling assembly is designed in a modular way, wherein the cooling panels can be regarded as modules. Normally, the panels are disposed next to each other along a surface of the charging installation that faces the reactor.

In any case, the panels can be pre-manufactured outside the charging installation and then be installed one after another. As mentioned before, the cooling assembly usually operates under severe conditions and still has to function perfectly to protect other parts of the charging installation. Therefore, the panels may need to be inspected, maintained and possibly replaced. It is understood that these operations are greatly facilitated by the use of modular panels, which can be removed individually for inspection, maintenance and/or replacement. In a preferred embodiment, all cooling panels are identical, so that a replacement panel can be used in any position. It should also be noted that such inspection, maintenance and/or replacement may be carried out from inside the charging installation.

To further facilitate mounting and dismounting of the panels, it is preferred that the cooling panels are mounted by a detachable connection. They may be mounted detachably to each other and/or to the rest of the charging installation. Usually, the detachable connection will be a bolted connection.

The coolant channels may be formed by normal tube-like pipes as known in the art. For easy manufacturing, however, it is preferred that each panel comprises a base plate in which at least one coolant channel is formed. Usually, the shape of the base plate will more or less correspond to the overall shape of the panel itself. The channel may be formed along with the base plate in a primary forming process like casting or it may be machined into the pre-manufactured base plate. The latter may provide increased cooling efficiency.

The base plate may be formed of various kinds of material. Of course, these materials need to have sufficient mechanical stability and need to withstand elevated temperatures and possibly temperature differences. Since good thermal conductivity also facilitates the cooling process, the base plate is preferably made of metal, e.g. steel.

The channel is formed as a groove in the base plate, which groove is covered by a cover plate mounted on the base plate. I.e., if the base plate has a top surface and a bottom surface, the channel could be formed as a groove in the top surface, while the bottom surface is completely plane. Obviously, in this embodiment, there are practically no limits to the shape of the channel, i.e. it may be straight or curved and can have various kinds of cross-sections. Such a channel may be produced easily by milling. Of course, the top side of the channel needs to be closed for safe containment of the coolant. Therefore, the cover plate is mounted on the base plate, e.g. by welding.

As mentioned before, the coolant channel can have various shapes. It is of course desirable that the whole area of the panel is near a coolant channel. While this can be achieved by a plurality of coolant channels or a branching coolant channel, respectively, it is preferred that the coolant channel has a meandering structure. Thus, the single, unbranching coolant channel may cover a large area.

Preferably, the cover plate has a meandering structure following the meandering structure of the coolant channel. If there is a deformation of the base plate, there is a movement in the coolant channel With a cover plate closely replicating the shape of the coolant channel, it is possible to reduce the risk of the weld between the cover plate and the base plate breaking, as the cover plate will follow the movement of the coolant channel.

Of course, the coolant channels need to be connected to a coolant supply. On the one hand, it is conceivable to connect the coolant channels of different panels directly with each other. It is preferred, though, that each panel comprises at least one coolant pipe, which is connected to the coolant channel Especially when the coolant channel is a groove within the base plate, connecting and disconnecting of the coolant channel and the coolant supply can be greatly facilitated if a coolant pipe is available, which protrudes from the surface of the base plate and may have a standard connector.

Even when the above-mentioned coolant pipes are employed, the coolant channels of different panels may be connected in series. For instance, there could be a single inlet and a single outlet for the whole cooling assembly. In such a case, the added-up length of the channels may lead to a considerable pressure drop, which in turn necessitates the use of booster pumps. Furthermore, the panels which are closer to the outlet will receive coolant that has already been warmed by flowing through several other panels. For these reasons, it is preferred that coolant channels of different panels are connected in parallel to a coolant supply. This includes the possibility that small groups of panels, e.g. two or three, could be connected in series. Preferably, the coolant channels of any two different panels are connected in parallel, which means that each cooling channel is directly connected to coolant supply. This configuration results in a relatively low pressure drop and makes it possible to use e.g. the coolant supply of a cooling circuit belonging to the metallurgical reactor also as cooling supply for the cooling assembly.

A serious problem with charging installations known in the art is the maintenance of a refractory layer, which is usually necessary additionally to be cooling system. Such a refractory layer normally is placed between the cooling circuit and the reactor. Usually, the refractory layer material deteriorates over time and has to be replaced at least partially. According to prior art, a refractory material, for example concrete, is gunited or shotscreened from the reactor side, which is difficult, time-consuming and possibly dangerous. These problems are overcome in a preferred embodiment, where at least one heat protection element is mounted to each cooling panel. The heat protection element of course should be flame-resistant, i.e. refractory. Low heat conductivity is also desirable for the heat protection element. In particular when each panel is mounted by a detachable connection, the replacement and/or maintenance of the heat protection element can be done easily by dismounting the panel and removing it from the charging installation. Even if the heat protection element is replaced or repaired by guniting, this may be done in an appropriate place with better working conditions. The heat protection element could be a layer of refractory material that is cast or gunited onto the panel. Alternatively it could be a kind of plate or tile, which is connected to the panel.

According to an aspect, a plurality of heat protection tiles are disposed adjacent to each other along a surface. The surface along which the tiles are disposed may be plane, bent or other. The term "surface" herein is to be understood in a geometrical way, i.e. it does not necessarily have to be the physical surface of a device. Each tile is heat-protective in that it is heat-resistant, in particular fire-resistant, and has by its geometry some shielding capacity. Heat resistance may be desired up to about 1200° C. as such temperatures may be reached in case of an incident. Each tile normally comprises a refractory material. A gap may be provided between adjacent tiles. The gap allows for a thermal expansion of the individual tiles. The thermal stress within an individual tile is therefore relatively small compared to the stress in a monolithic refractory layer. The size of the gap may be chosen according to the expected thermal expansion of the tiles under the operating conditions of the charging installation. The tiles may be allowed to touch each other when the top temperatures of the installation are reached, since the thermal stress in such a case is still less than with a monolithic structure. On the other hand, the size of the gap at room temperature can be chosen so that it will not close even at top temperatures. However, the size of the gap should not be too great, since this could negatively affect the shielding properties of the heat protection assembly. It is possible that the tiles overlap, e.g. like a tongue and groove, so that an expansion of the tiles is possible while heat convection through the gap is hindered. It is also within the scope that some material is placed within the gap as long as this material does not hinder the thermal expansion of the individual tiles too much. The material may e.g. be highly compressible.

According to a preferred embodiment, the tiles comprise a support structure on which a refractory material is disposed. Such as support structure forms a kind of "backbone" of the tile. Normally, the support structure will be made of material that is highly resistant to thermal expansion and contraction processes, i.e. the material is very unlikely to form cracks under these processes. It goes without saying that the material should have a melting point that is considerably higher than the expected temperatures during operation of the charging installation. Possible materials are ceramic or metals, for example steel. The refractory material, which is disposed of the support structure, of course has to be highly heat resistant and flame resistant. Preferably, it is a poor heat conductor. The latter property is not so crucial for the support structure. On the other hand, the refractory material does not have to be as resistant to thermal deformation processes, because even if small cracks form in the refractory material, it may still be held in place by the connection to the support structure.

It is preferred that the refractory material can be cast onto or around the support structure. I.e., the refractory material should be applicable in a liquid or semi-liquid form, which solidifies after application to the support structure. One such material which is preferred is refractory concrete.

This also opens the possibility of forming the gap by placing a kind of "spacer" material in the position of the intended gap before casting the refractory material. The spacer material may be removed after the casting process before the tile is installed to the charging installation. Alternatively, the gap may be filled with a material which is volatile under the operating temperatures of the metallurgical reactor. I.e., the spacer material is volatile and can be left in place during installation of the tile. "Volatile" in this context refers to materials that will melt and/or evaporate as well as materials which disappear due to a chemical reaction at high temperatures, usually due to combustion. Of course, since the only function of the material is to provide a kind of "die" for the casting process of the refractory material and the spacer material is lost during operation of the reactor, cheap materials are preferred for this purpose. For example, wood-based or paper materials can be used. A particularly preferred material is cardboard.

Preferably, the support structure comprises a mesh on which the refractory material is disposed. The mesh structure, which may be essentially two-dimensional or three-dimensional, helps to cover a large space with relatively little material. Depending on the material used for the support structure, this may help to keep the weight and/or the cost of the tile low. Also, since the heat conductivity of the support structure is often higher than that of the refractory material, it is desirable to use as little support structure as possible.

There are a multitude of different mesh configurations which may be used. Some may be essentially two-dimensional, like wire mesh. Especially when the thickness of the tile is greater, three-dimensional structures will be preferred. According to one preferred embodiment, the mesh is hexagonal. The hexagonal structure is preferably disposed along the plane of the tile, so that the support structure resembles a honeycomb.

The disclosure may in particular be used for a charging installation which comprises a casing for a gear assembly. Here, the cooling assembly is configured to protect an annular bottom surface of the casing. In this case of course, the bottom surface of the casing is facing the reactor. Such a configuration is also disclosed in WO 2012/016902 A1, which is hereby included by reference. Here, a conventional cooling circuit is employed, though. The gear assembly is part of a tilting mechanism for a distribution chute of the charging installation. The casing may also be considered as a gearbox, since it forms a housing for the gear assembly. However, the gear assembly is able to rotate within the housing.

It is highly preferred that the cooling panels are mountable and dismountable from inside the casing. Since the casing usually has an access door for maintenance of the gear assembly or the like, the inside is easily accessible. If connection means like bolts are accessible from the inside, mounting or dismounting of the panels can be performed easily and safely.

In many applications, the panels are too heavy to be handled manually. Therefore, some kind of hoist needs to be applied. While it is possible to introduce such a device into the casing for each maintenance operation and take it out again afterwards, it is preferred that a hoist device for handling the panels is disposed (or mounted) inside the casing. One example for such a hoist device is a gantry crane. In an annular casing as the one shown in WO 2012/016902 A1, the gantry crane may comprise an annular beam disposed near the top of the casing. It may thus be placed above any section of the casing to lift any panel located on the bottom.

A cooling assembly for a charging installation of a metallurgical reactor is further provided. The cooling assembly is disposable for cooling a reactor side of the charging installation and comprises a plurality of cooling panels, each cooling panel comprising at least one coolant channel. "Disposable for cooling" herein means that the assembly is adapted for cooling the above-mentioned reactor side. I.e., the dimensions and the shape of the parts of the cooling assembly must be adapted for this purpose. In particular, the parts of the cooling assembly can be adapted to be mounted on are within the charging installation. In the above-mentioned case, where the reactor side is an annular bottom surface, the parts need to be dimensioned to approximately cover this surface.

Preferred embodiments of the cooling assembly correspond to the preferred embodiments of the charging installation as described above.

Finally, a cooling panel is provided for a cooling assembly as described above. Preferred embodiments of the cooling panel have also been described above in context with the inventive charging installation.

BRIEF DESCRIPTION OF THE DRAWINGS

Details of the invention will now be described with reference to the drawings, wherein.

DESCRIPTION OF PREFERRED EMBODIMENTS

Figure 1:
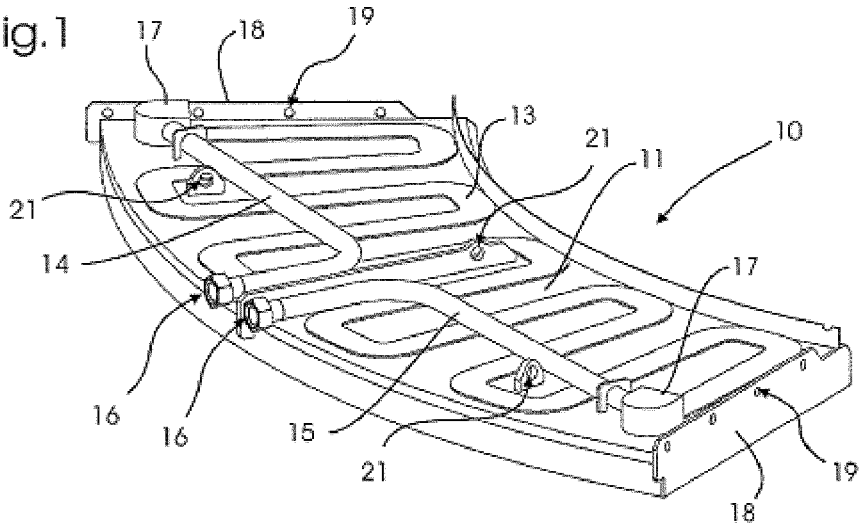
FIG. 1 is a perspective view of a cooling panel.

FIG. 1 shows a perspective view of a cooling panel 10 according to the present invention. The cooling panel 10 is part of a cooling assembly 4 which protects the annular bottom surface of the casing 2, which is part of a charging installation 1 for a metallurgical reactor. Due to the annular shape of the surface to be protected, the panel 10 is generally arc-shaped. Its general configuration is relatively flat and it comprises a planar base plate 11, which is made of steel. As can be seen in the cutaway view in FIG. 2, a coolant channel 12 has been machined into the surface of the base plate 11. To provide a fluid-tight seal of the coolant channel 12, it is closed on the upper side by a cover plate 13, which has the same meandering structure as the coolant channel 12 itself. The cover plate, which itself is made of steel, is connected to the base plate 11 by welding. The coolant channel 12 is connected to a supply pipe 14 and a drain pipe 15. These pipes 14, 15 are conventional, tube-shaped pipes which are mounted the surface of the base plate 11. Each of them is connected to the coolant channel 12 by an interface 17, which is adapted to this special type of connection. Each of the pipes 14, 15 comprises at an opposite end a standardized connector 16, by which it can be connected to a coolant supply. During operation of the cooling assembly 4, coolant flows through the connector 16 into inlet pipe 14 and from there via the interface 17 into the coolant channel 12. Due to the meandering structure of the coolant channel 12, the coolant basically flows along the whole surface of the panel 10. Afterwards, it flows via the interface 17 into the drain pipe 15 and from there via the connector 16 back to the coolant supply. On the lower side of the base plate 11, i.e. on the side facing the reactor, a heat protection layer 30 is disposed. This heat protection layer 30 comprises a plurality of refractory heat protection tiles, the structure of which will be discussed below. For heat insulation, a thermal insulation layer 32 of ceramic fiber material is disposed between the tiles and the base plate 11. On the edges of the arc formed by the panel 10, it comprises two side flanges 18 which extend perpendicular to the plane of the base plate 11. Each side flange 18 features of a plurality of through-holes 19. Three eyelets 21 are disposed on the upper side of the base plate 11, which facilitate handling of the panel 10 and by a hoist 41 or the like.

Figure 2:
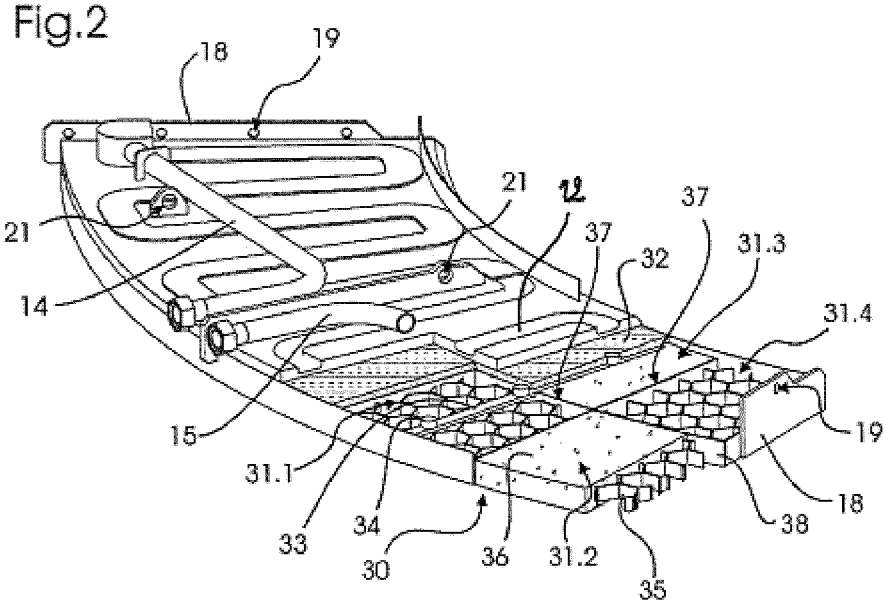
FIG. 2 is a perspective cutaway view of the cooling panel of FIG. 1.

As shown in FIG. 2, the base plate 11 also serves as a common carrier member for a plurality of heat protection tiles 31.1, 31.2, 31.3, 31.4, which form a heat protection layer 30. Each of the heat protection tiles 31.1, 31.2, 31.3, 31.4 is connected to the base plate 11 via knob-like spacer members 34 is, which are disposed on a mounting strip 33. A hexagonal mesh 35 is connected to the mounting strip 33. The mesh 35 serves as a backbone of the heat protection tiles 31.1, 31.2, 31.3, 31.4 and provides for structural integrity. The heat protection properties of the tiles mainly result from a block of refractory concrete 36 which is cast around the mesh 35. The heat protection tiles 31.1, 31.2, 31.3, 31.4 do not touch each other, but are provided with the gap 37 in between. This gap 37 allows for thermal expansion during operation of the heat protection layer 30.

In the production process, the mounting strip 33 with the mesh 35 is mounted to the base plate 11 before the refractory concrete 36 is applied. A strip of cardboard 38 is placed between the individual heat protection tiles 31.1, 31.2, 31.3, 31.4 to prevent concrete 36 from entering the gap 37. The refractory concrete 36 is then cast around the mesh 35. The cardboard 38 could be removed prior to installation of the panel 10, but this is not necessary. The cardboard 38 will quickly burn away under the operating conditions of the panel 10 and thus can be left within the gap 37, as shown in FIG. 2. The spacer members 34 provide for a space between the tile and the base plate 11, which space is filled with the heat insulation layer 32 composed of ceramic fibers. The heat protection panel 10 therefore is a module which combines three functional layers: the heat protection layer 30 with heat protection tiles 31.1, 31.2, 31.3, 31.4 protects against extreme temperatures and also provides thermal insulation, the insulation layer 32 further enhances the insulation effect, while the coolant channel 12 with the pipes 14, 15 provides for active cooling. The panel 10 is provided with side flanges 18, which extend perpendicular to the plane of the base plate 11. These side flanges 18 are provided with a plurality of through-holes 19 and are used to connect the panel 10 to neighboring panels and/or the charging installation. Three eyelets 21 are disposed on the upper side of the base plate 11, which facilitate handling of the panel 10 and by a hoist 41 or the like.

Figure 3:
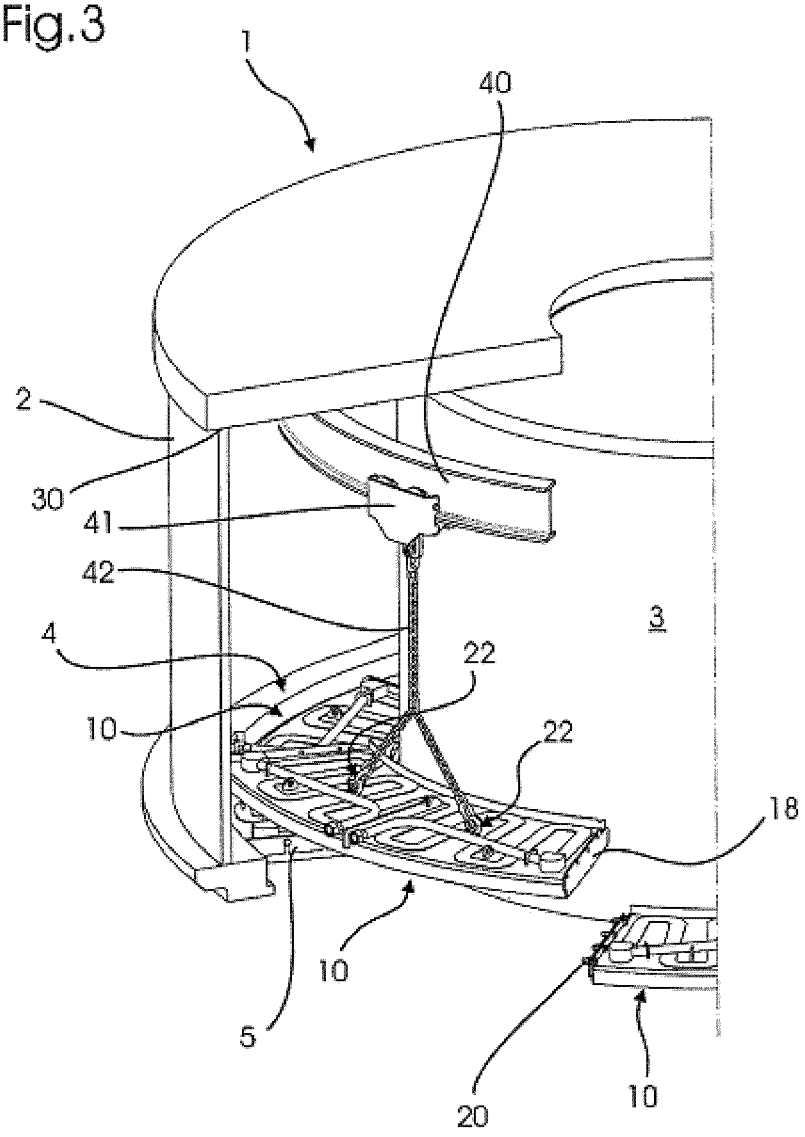
FIG. 3 is a perspective cutaway view of a charging installation in which the cooling panel of FIG. 1 is used.

FIG. 3 shows a partial cutaway view of a charging installation 1, which features an annular shaped casing 2 for a gear assembly and a cylindrical support 3 for the gear assembly. The gear assembly, which is not shown here, is used for tilting of a distribution chute of the charging installation 1. The support 3 is rotatably mounted with respect to the casing 2. As can be seen from FIG. 3, a plurality of cooling panels 10 are disposed next to each other along the annular bottom of the casing 2. Bolts 20, which are put through the holes 19, are used to connect each side flange 18 to a radially disposed plate-like mounting member 5 of the casing 2. At the same time, the bolts 20 serve to interconnect the individual panels 10.

As can be seen in FIG. 3, a beam 40 of a gantry crane 41 is connected to the top of the casing 2. The beam 40 is annular-shaped and allows the crane 41 to be moved to virtually any position within the casing 2. FIG. 3 illustrates the removal of a cooling panel 10, which is lifted by a chain 42 of the gantry crane 41. FIG. 3 shows the chain connected to hoist rings 22, which are not shown in FIGS. 1 and 2. Alternatively, the chain 42 could be connected to the eyelets 21. By moving the gentry crane 41 along the beam 40, the cooling panel 10 may be moved to an access door (not shown) of the casing 2, from where it may be removed for repair or replacement. A replacement panel can be installed by a reverse sequence of operations. It is therefore apparent that a replacement of the cooling panel 10 can be achieved in short time and easily. In particular, there is no need for personnel to work on the underside of the cooling assembly 4, i.e. near or within the reactor itself. The mounting and dismounting can be done from within the casing 2. This makes the work not only easier but also significantly adds to the safety of the working personnel.

The invention claimed is:

1. A charging installation of a metallurgical reactor, comprising:

a cooling assembly disposed for cooling a reactor side of the charging installation, wherein the cooling assembly comprises a plurality of cooling panels, wherein each cooling panel comprises a base plate in which at least one coolant channel is formed, wherein the coolant channel is formed as a groove in the base plate, wherein said groove is covered by a cover plate mounted on and elevated on top of the base plate, wherein the coolant channel has a meandering structure and the cover plate has a meandering structure replicating the shape of the coolant channel, the meandering structure being configured to reduce the risk of a weld disposed between the cover plate and the base plate from breaking whereby the cover plate follows the movement of the coolant channel, and wherein a plurality of eyelets are disposed on an upper side of the base plate, such that the cooling panel is configured to be removable.

2. The charging installation according to claim 1, wherein each cooling panel is mounted by a detachable connection.

3. The charging installation according to claim 1, wherein the base plate is made of metal.

4. The charging installation according to claim 1, wherein each panel comprises at least one coolant pipe which is connected to the coolant channel.

5. The charging installation according to claim 1, wherein coolant channels of different panels are connected in parallel to a coolant supply.

6. The charging installation according to claim 1, wherein at least one heat protection element is mounted to each cooling panel.

7. The charging installation according to claim 6, wherein the heat protection element comprises a plurality of heat protection tiles, said tiles being disposed adjacent to each other along a surface.

8. The charging installation according to claim 7, wherein the heat protection tiles comprise a support structure on which a refractory material, is disposed.

9. The charging installation according to claim 7, wherein a gap is arranged between neighbouring heat protection tiles and wherein the gap is filled with a material which is volatile under the operating temperatures of the metallurgical reactor.

10. The charging installation according to claim 8, wherein the support structure comprises a mesh on which the refractory material is disposed.

11. The charging installation according to claim 1, further comprising a casing for a gear assembly and the cooling assembly configured to protect an annular bottom surface of the casing.

12. The charging installation according to claim 7, wherein the cooling panels are mountable and dismountable from inside a casing for a gear assembly and the cooling assembly configured to protect an annular bottom surface of the casing.

13. The charging installation according to claim 7, wherein a hoist device for handling the panels is disposed inside a casing for a gear assembly and the cooling assembly configured to protect an annular bottom surface of the casing.

14. A cooling assembly for a charging installation of a metallurgical reactor, said cooling assembly disposable for cooling a reactor side of the charging installation and comprising:

a plurality of cooling panels, each cooling panel comprising a base plate in which at least one coolant channel is formed, wherein the coolant channel is formed as a groove in the base plate, said groove being covered by a cover plate mounted on and elevated on top of the base plate, and wherein the coolant channel has a meandering structure and the cover plate has a meandering structure following the meandering structure of the coolant channel, the meandering structure being configured to reduce the risk of a weld disposed between the cover plate and the base plate from breaking whereby the cover plate follows the movement of the coolant channel, and wherein a plurality of eyelets are disposed on an upper side of the base plate, such that the cooling panel is configured to be removable.

15. A cooling panel for a cooling assembly disposable for cooling a reactor side of a charging installation, said cooling panel comprising:

a base plate in which at least one coolant channel is formed, wherein the coolant channel is formed as a groove in the base plate, said groove being covered by a cover plate mounted on and elevated on top of the base plate, and wherein the coolant channel has a meandering structure and the cover plate has a meandering structure following the meandering structure of the coolant channel, the meandering structure being configured to reduce the risk of a weld disposed between the cover plate and the base plate from breaking whereby the cover plate follows the movement of the coolant channel, and wherein a plurality of eyelets are disposed on an upper side of the base plate, such that the cooling panel is configured to be removable.

* * * * *